United States Patent [19]

Erickson et al.

[11] Patent Number: 5,058,538

[45] Date of Patent: Oct. 22, 1991

[54] HYDRAULICALLY PROPELLED PHNEUMATICALLY RETURNED VALVE ACTUATOR

[75] Inventors: Frederick L. Erickson; William E. Richeson, both of Fort Wayne, Ind.

[73] Assignee: North American Philips Corporation, New York, N.Y.

[21] Appl. No.: 557,369

[22] Filed: Jul. 24, 1990

[51] Int. Cl.[5] ..... F01L 9/02

[52] U.S. Cl. ..... 123/90.12; 92/134; 91/454; 91/459; 123/90.65

[58] Field of Search ..... 91/454, 459; 92/134; 251/47; 123/90.12, 90.13, 90.14

[56] References Cited

U.S. PATENT DOCUMENTS

| | | | |
|---|---|---|---|
| 3,537,355 | 11/1970 | Bliss | 91/459 |
| 4,555,974 | 12/1985 | Mason et al. | 91/459 |
| 4,563,941 | 1/1986 | Soendergaard | 92/134 |
| 4,669,358 | 6/1987 | Aspervall et al. | 91/465 |
| 4,759,260 | 7/1988 | Lew | 92/134 |
| 4,777,800 | 10/1988 | Hay, II | 92/134 |
| 4,809,587 | 3/1989 | Kawahara et al. | 91/166 |
| 4,836,757 | 6/1989 | Curwen et al. | 92/134 |
| 4,889,035 | 12/1989 | Goodnow | 91/DIG. 4 |
| 4,922,805 | 5/1990 | Beswick | 92/165 R |

FOREIGN PATENT DOCUMENTS

| | | | |
|---|---|---|---|
| 1132034 | 12/1984 | U.S.S.R. | 123/90.12 |

*Primary Examiner*—E. Rollins Cross
*Assistant Examiner*—Weilun Lo
*Attorney, Agent, or Firm*—Robert J. Kraus

[57] ABSTRACT

An actuator which is used, for example, to operate an internal combustion engine poppet valve is configured to open the poppet valve by means of a high pressure hydraulic fluid. This fluid powers the actuator piston and, at the same time, compresses air to accomplish both damping of the piston and conversion of the kinetic energy of piston translation into potential (pneumatic) energy. The actuator is held or captured in the second or valve-open position by a hydraulic latch and when released, is returned by the stored pneumatic energy to its initial position. Damping of the returning actuator piston is accomplished by a separate adjustable pneumatic orifice arrangement to assure gentle seating of the poppet valve.

13 Claims, 8 Drawing Sheets

HYDRAULICALLY PROPELLED PHNEUMATICALLY RETURNED VALVE ACTUATOR

SUMMARY OF THE INVENTION

The present invention relates generally to two position straight line motion actuators as may, for example, be utilized to actuate the poppet valves of internal combustion engines and especially to such actuators which are bistable and asymmetric in their operation. More specifically, the present invention relates to a hydraulically powered, hydraulically latched actuator with stored pneumatic energy return. Electrical energy is used for the timed triggering of the transitions.

The prior art has recognized numerous advantages which might be achieved by replacing the conventional mechanical can actuated valve arrangements in internal combustion engines with other types of valve opening mechanisms which could be controlled in their opening and closing as a function of engine speed as well as engine crankshaft angular position or other engine parameters.

For example, in U.S. patent application Ser. No. 226,418, now U.S. Pat. No. 4,945,870, entitled VEHICLE MANAGEMENT COMPUTER filed in the name of William E. Richeson on July 29, 1988 there is disclosed a computer control system which receives a plurality of engine operation sensor inputs and in turn controls a plurality of engine operating parameters including ignition timing and the time in each cycle of the opening and closing of the intake and exhaust values among others.

U.S. Pat. No. 4,009,695 discloses hydraulically actuated valves in turn controlled by spool valves which are themselves controlled by a dashboard computer which monitors a number of engine operating parameters. This patent references many advantages which could be achieved by such independent valve control, but is not, due to its relatively slow acting hydraulic nature, capable of achieving these advantages. The patented arrangement attempts to control the valves on a real time basis so that the overall system is one with feedback and subject to the associated oscillatory behavior.

U.S. Pat. No. 4,700,684 suggests that if freely adjustable opening and closing times for inlet and exhaust values is available, then unthrottled load control is achievable by controlling exhaust gas retention within the cylinders.

Substitutes for or improvements on conventional cam actuated values have long been a goal. In the Richeson U.S. Pat. No. 4,794,890 entitled ELECTROMAGNETIC VALVE ACTUATOR, there is disclosed a valve actuator which has permanent magnet latching at the open and closed positions. Electromagnetic repulsion may be employed to cause the valve to move from one position to the other. Several damping and energy recovery schemes are also included.

In copending application Ser. No. 153,257, U.S. Pat. No. 4,878,464 entitled PNEUMATIC ELECTRONIC VALVE ACTUATOR, filed February 8, 1988 in the names of William E. Richeson and Frederick L. Erickson and assigned to the assignee of the present application there is disclosed a somewhat similar valve actuating device which employs a release type mechanism rather than a repulsion scheme as in the previously identified U.S. patent. The disclosed device in this application is a jointly pneumatically and electromagnetically powered valve with high pressure air supply and control valving to use the air for both damping and as one motive force. The magnetic motive force is supplied from the magnetic latch opposite the one being released and this magnetic force attracts an armature of the device so long as the magnetic field of the first latch is in its reduced state. As the armature closes on the opposite latch, the magnetic attraction increases and overpowers that of the first latch regardless of whether it remains in the reduced state or not.

The foregoing as well as a number of other related applications all assigned to the assignee of the present invention and filed in the name of William E. Richeson or William E. Richeson and Frederick L. Erickson are summarized in the introductory portions of the copending Ser. No. 07/294,728, now U.S. Pat. No. 4,875,441, filed in the names of Richeson and Erickson on January 6, 1989 and entitled ENHANCED EFFICIENCY VALVE ACTUATOR.

Many of the later filed above noted cases disclose a main or working piston which drives the engine valve and which is, in turn powered by compressed air. The power or working piston which moves the engine valve between open and closed positions is separated from the latching components and certain control valving structures so that the mass to be moved is materially reduced allowing very rapid operation. Latching and release forces are also reduced. Those valving components which have been separated from the main piston need not travel the full length of the piston stroke, leading to some improvement in efficiency. Compressed air is supplied to the working piston by a pair of control valves with that compressed air driving the piston from one position to another as well as typically holding the piston in a given position until a control valve is again actuated. The control valves are held closed by permanent magnets and opened by pneumatic force on the control valve when an electrical pulse to a coil near the permanent magnet neutralizes the attractive force of the magnet.

An electronically controlled pneumatically powered actuator as described in our U.S. Pat. No. 4,825,528 has demonstrated very rapid transit times and infinite precise controllability. Devices constructed in accordance with this patent are capable of obtaining optimum performance from an internal combustion engine due to their ability to open and then independently close the poppet valves at any selectable crank shaft angles. In this prior patented arrangement, a source of high pressure air is required for both opening and for closing the valves. Moreover, such devices require a certain amount of duplication of structure in that symmetrical propulsion, exhaust air release, and regulated latching pressure (damping air) arrangements are needed. In this prior art configuration, substantially the same volume of air must be used to close the valve as was required to open it.

In the devices of these applications, air is compressed by piston motion to slow the piston (dampen piston motion) near the end of its stroke and then that air is abruptly vented to atmosphere. When the piston is slowed or damped, its kinetic energy is converged to some other form of energy and in cases such as dumping the air compressed during damping to atmosphere, that energy is simply lost. U.S. Pat. Nos. 4,883,025 and 4,831,973 disclose symmetric bistable actuators which attempt to recapture some of the piston kinetic energy as either stored compressed air or as a stressed mechanical spring which stored energy is subsequently used to power the piston on its return trip. In either of these patented devices, the energy storage device is symmetric and is releasing its energy to power the piston during the first half of each translation of the piston and is consuming piston kinetic energy during the second half of the same translation regardless of the direction of piston motion.

In copending Ser. No. 07/457,015, now U.S. Pat. No. 4,974,495, December 26, 1989 in the name of William E. Richeson, there is disclosed a hydraulically powered valve actuating mechanism including, inter alia, a high pressure hydraulic fluid accumulator in close proximity to the cavity in which the fluid is to do its work. It is somewhere between inefficient and impossible to move hydraulic fluid over a wide temperature range rapidly through long lines of relatively small cross-section. This application provides a chamber expandable against spring-loaded pistons in very close proximity to the working chamber of the actuator to which high pressure fluid is continuously supplied and from which a larger volume of fluid may be efficiently intermittently removed.

Our recent invention entitled ACTUATOR WITH ENERGY RECOVERY RETURN propels an actuator piston from a valve-closed toward a valve-open position and utilizes the air which is compressed during the damping process to power the actuator back to its initial or valve-closed position. Moreover, an actuator capture or latching arrangement, such as a hydraulic latch, is used in this recent invention to assure that the actuator does not immediately rebound, but rather remains in the valve-open position until commanded to return to its initial position. The initial translation of the actuator piston in this recent application is powered by pneumatic energy and requires a relatively large source pump as well as relatively large individual valve actuators.

The entire disclosures of all of the above identified copending applications and patents are specifically incorporated herein by reference.

The present invention takes advantage of many of the developments disclosed in the lastmentioned ACTUATOR WITH ENERGY RECOVERY RETURN application while the initial powered translation is accomplished by hydraulic energy from a hydraulic pump rather than by pneumatic energy. Hydraulic energy propulsion yields the advantages of reduced actuator size and, therefor, is easier to package, as well as a reduction of the size of and, therefor, the space required underneath a vehicle hood by the hydraulic pump. Also, in furtherance of the goal of reduction in size, the compression of latching air and pneumatic energy recovery feature is accomplished in a smaller chamber than taught in our ACTUATOR WITH ENERGY RECOVERY RETURN application. The reduction in size is accompanied by a correlative increase in peak pressure of the compressed air. The latching pressure must be correspondingly increased, and in particular, a decrease in piston diameter to one-half the former value requires a corresponding four-fold increase in pressure to maintain the same overall latching force.

The present invention also utilizes a third chamber behind the energy recovery piston which functions as the primary damping chamber for piston motion near the end of its return trip to the valve-closed position. It is not only important to damp piston motion as the internal combustion engine valve nears its closed position allowing the valve to gracefully close, it is also important to insure that the valve is fully and positively seated. A dual damping function with an arrangement for individually adjusting each step of the damping process assures gentle seating of the engine poppet valve.

The present invention utilizes a closely coupled fluid accumulator to assure a rapid flow of the non-compressible fluid into the actuator. A bladder type accumulator with the fluid supply therein being continuously replenished and with the fluid supply being refilled or catching up between actuator translations is utilized along with a low viscosity, high viscosity index fluid having a broad temperature range to insure rapid response under a wide range of conditions as the fluid travels from the accumulator, through a one-way valve and into the actuator. If the particular task of the actuator is sufficiently demanding, a spring loaded high pressure accumulator as disclosed in the abovementioned Richeson Ser. No. 07/457,015 application, which is entitled ELECTRO-HYDRAULIC VALVE ACTUATOR, may be employed.

Finally, the permanent magnet latching schemes so common in many of our earlier applications have, as in the ACTUATOR WITH ENERGY RECOVERY RETURN application, been eliminated along with their associated cost and weight.

Among the several objects of the present invention may be noted the provision of an asymmetrical bistable valve actuator of improved design; the provision of a hydraulically driven, pneumatically returned valve actuator; the provision of an increased pressure, reduced size hydraulic capture arrangement for temporarily delaying the return of an internal combustion engine to its valve-closed position; the provision of an expandable fluid accumulator closely adjacent a fluid powered actuator to provide close coupling and fast response of the actuator; the provision of individually adjustable dual damping features in a valve actuator; an overall reduction in electronically controllable valve actuator size as well as a reduction in the size of the support system for such valve actuators; and an arrangement in an internal combustion engine valve actuator for easing the valve gently yet solidly into its valve-closed position. These as well as other objects and advantageous features of the present invention will be in part apparent and in part pointed out hereinafter.

In general, a bistable electronically controlled hydraulically powered transducer has an armature which is reciprocable between first and second positions along with a hydraulic arrangement for powering the armature from the first position to the second position. There is a pneumatic energy storage chamber in which air is compressed during motion of the armature from the first position to the second position with the compression of the air damping or slowing armature motion as it nears the second position. Reversal of armature motion when the motion of the armature has slowed to a stop is temporarily prevented by a hydraulic latch which is disableable on command to allow the air compressed in the chamber to return the armature to the first position. The hydraulic latch and the hydraulic powering arrangement may utilize the same hydraulic chamber. Also, when we say reversal of armature motion is prevented, this language is intended to encompass the fact that there may be a slight reverse movement until the hydraulic fluid in this chamber is compressed to a pressure sufficient to preclude further motion. There is a second or return damping chamber in which air is compressed during motion of the armature from the second position back to the first position, and an arrangement for providing a controlled venting of the air from this second chamber and therefore also a controlled damping of the armature motion as that armature moves from the second position back to the first position. This controlled venting of air from the second chamber is achieved by a first adjustable aperture which allows air to escape from the chamber during less than the entire travel of the armature back from the second position to the first position; and a second adjustable aperture which allows air to escape from the chamber the entire time the armature is travelling back to the first position. These two apertures act together to provide a preliminary mild damping of armature motion. The first aperture is closed by armature motion part way through the transition and subsequent action of the second aperture by itself provides a more severe final damping of the armature motion. There is a hydraulic fluid accumulator located in close proximity to the area of the armature which is powered by the fluid for continuously receiving high pressure fluid and intermittently supplying fluid to power the armature. The closely adjacent accumulator insures a rapid, low loss response by the armature.

Also in general and in one form of the invention, an electronically controllable hydraulically powered valve actuating mechanism for use in an internal combustion engine having engine intake and exhaust valves with elongated valve stems includes a power piston reciprocable along an axis and adapted to be coupled to an engine valve. The piston is hydraulic unilaterally moved, thereby causing the engine valve to move in the direction of stem elongation from a valve-closed to a valve-open position. The hydraulic source for powering the piston may include a hydraulic fluid accumulator in close proximity to the area of the piston for continuously receiving high pressure fluid and intermittently supplying fluid to power the piston. A pneumatic damping arrangement is provided for compressing a volume of air and imparting a continuously increasing decelerating force as the engine valve approaches the valve-open position. Finally, the compressed volume of air is utilized on command to power the piston back to the valve-closed position.

BRIEF DESCRIPTION OF THE DRAWING

Corresponding reference characters indicate corresponding parts throughout the several views of the drawing.

The exemplifications set out herein illustrative a preferred embodiment of the invention in one form thereof and such exemplifications are not to be construed as limiting the scope of the disclosure or the scope of the invention in any manner.

DESCRIPTION OF THE PREFERRED EMBODIMENT

The present invention utilizes hydraulic fluid to power an actuator for an initial position to a second position. The invention takes advantage of the concepts disclosed in our abovementioned *ACTUATOR WITH ENERGY RECOVERY RETURN* application wherein a precise quantity of air is trapped, compressed and stored on the obverse side of the actuator piston as that piston nears its second (valve-open) position. The compressed air and its associated potential energy is stored by locking or capturing the piston shaft by a fluid latch which is made an integral part of a hydraulic system. The actuator may then be commanded to return to the first position by releasing the latching fluid allowing the stored compressed air to return the actuator to the valve-closed position.

Figure 1:
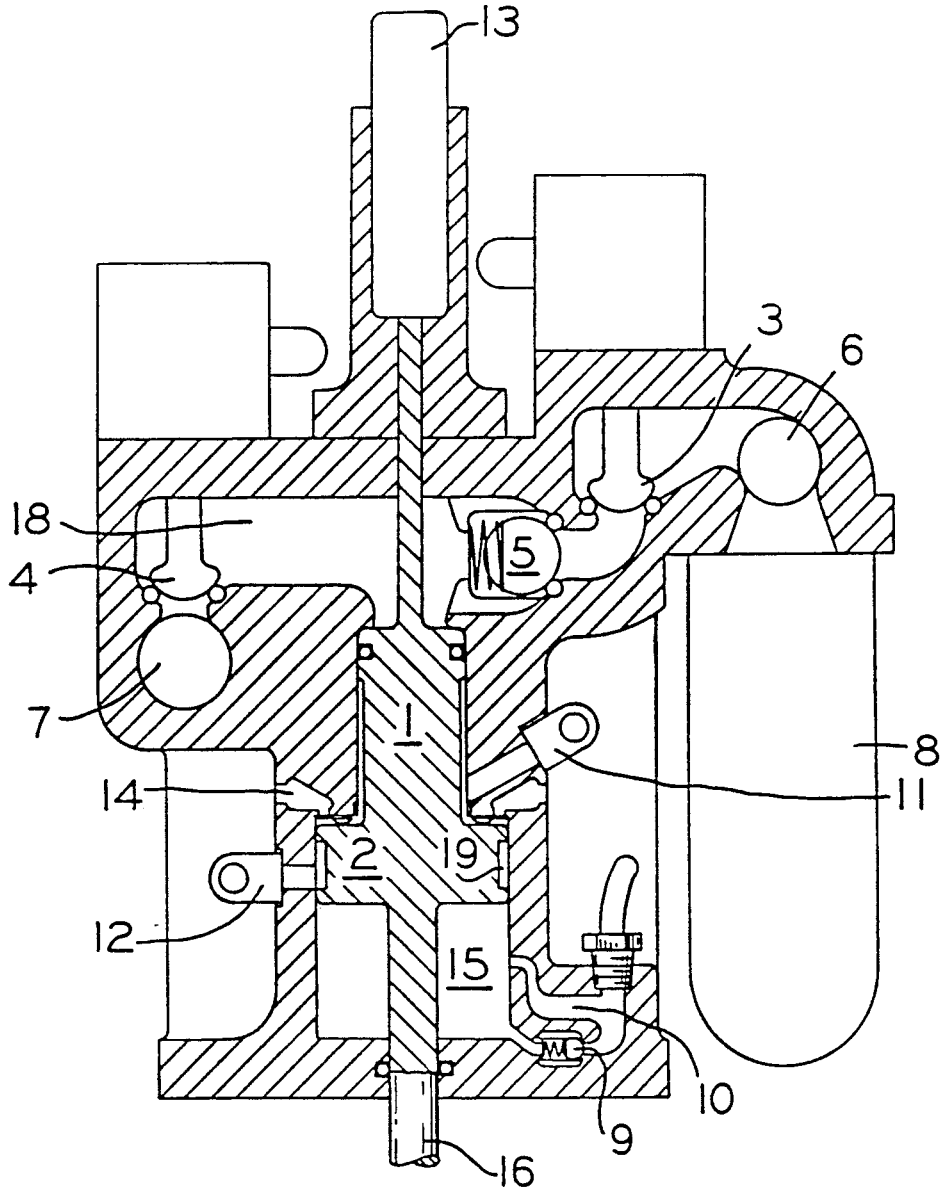
FIG. 1 is a view in cross-section of the actuator in the valve-seated position and illustrating our invention in one form.
Figure 2:
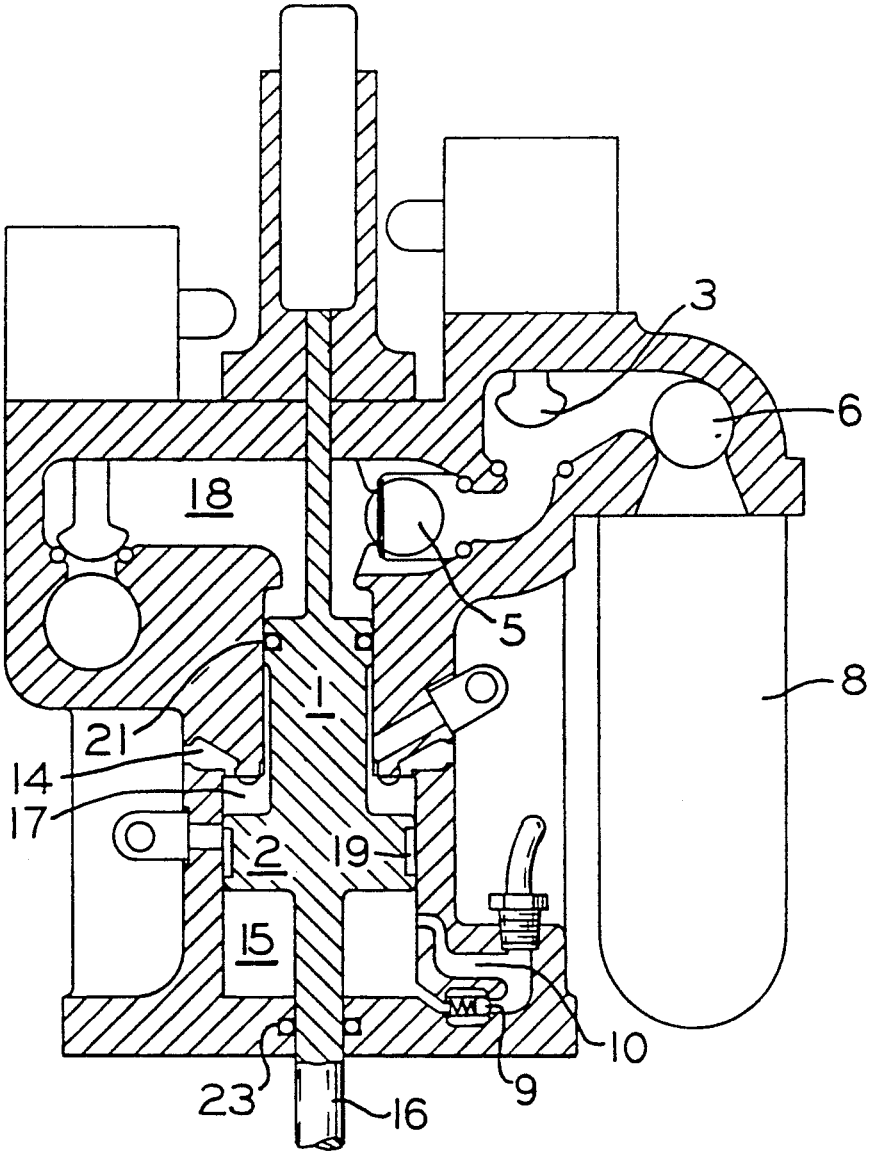
FIG. 2 is a cross-sectional view similar to FIG. 1, but wherein a first valve has opened supplying hydraulic pressure to begin moving the actuator toward the right.

FIG. 1 shows the actuator in its first or rest position in which the engine valve is closed. The shaft 16 connects to a conventional internal combustion engine poppet valve (not shown). Comparing FIGS. 1 and 2, when a ball valve 3 is opened by a solenoid the high pressure hydraulic fluid in the accumulator 8 quickly forces the ball valve 5 open and applies high pressure to the hydraulic subpiston 1. The high pressure causes the subpiston 1 and its interconnected piston 2 to move to the right. This subpiston is formed as the left hand portion including the reduced diameter face of the power piston 2. These two pistons 1 and 2 may be physically formed from the same place of material as a piston assembly, yet are isolated from one another by leak-proof seals 19, 21 and 23. These seals create a hydraulic chamber 18, a compressed air chamber 15 and a damping air chamber 17. As the piston assembly is propelled toward the right by hydraulic pressure in chamber 18, the air in chamber 15 is being compressed by the right face of piston 2 and will be retained as the primary motive force for the return of the piston assembly to the initial piston of FIG. 1. During rightward motion of the piston assembly, atmospheric pressure air is entering chamber 17 in an unrestricted manner through reed valve assembly 14. Chamber 15 is initially charged with low pressure regulated air from port 10 and one-way ball check valve 9 to maintain a minimal satisfactory latching force on piston 2. This pneumatic latching force keeps the engine's poppet valve properly seated until commanded to open.

Figure 3:
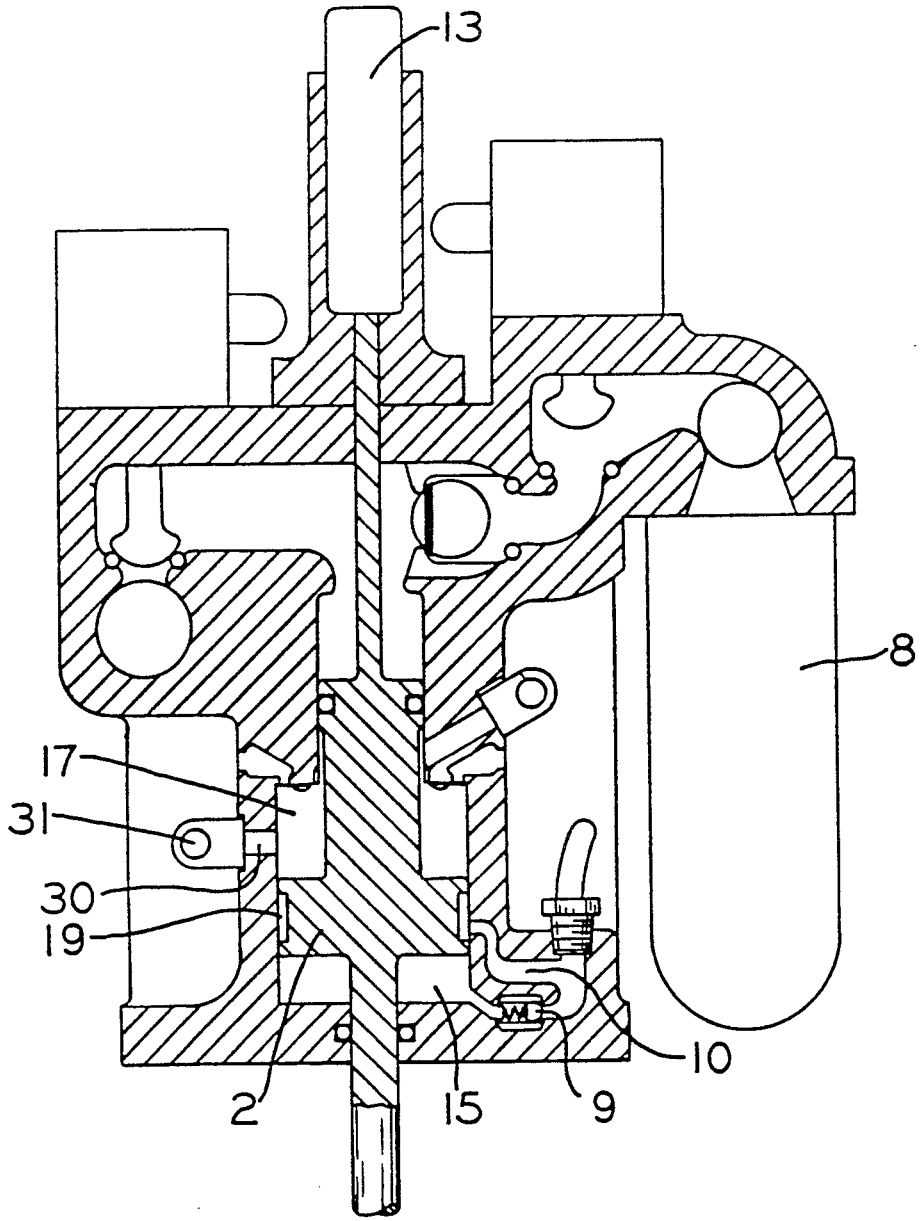
FIG. 3 is a cross-sectional view similar to FIGS. 1 and 2, but illustrating the actuator piston in a location where its motion is being damped by compressing a predetermined volume of air.

In FIG. 3, the actuator piston is continuing its rightward travel. In this FIG., the piston seal 19 has just covered the sidewall opening and cut off the latching air port 10. With the piston positioning as in FIG. 3, the air in chamber 15 is being compressed to a very high pressure. This pressure provides a positive damping force to slow the motion of the actuator piston as it approaches its extreme right hand or second position.

Figure 4:
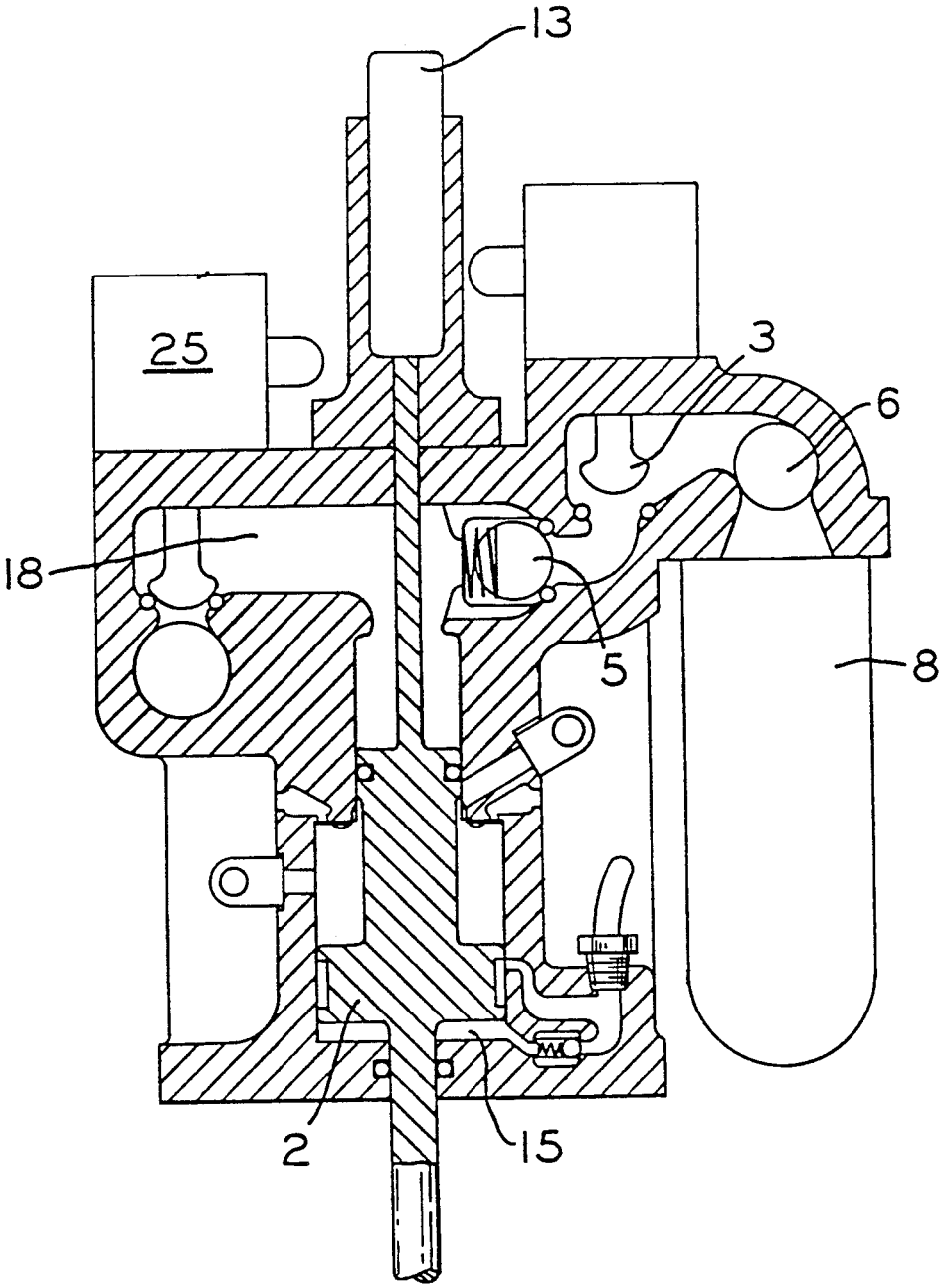
FIG. 4 is a cross-sectional view similar to FIGS. 1–3, but wherein the actuator piston has reached its rightmost position, its motion arrested, and is being held against the force of the compressed air.

FIG. 4 illustrates the actuator just after the piston assembly has reached its rightward extreme position. The very high pressure air in chamber 15 has displaced the piston 2 back slightly toward the left to compress the fluid in chamber 18 to a pressure higher than the system pressure as supplied from the accumulator 8. Pressure in chamber 18 above the system pressure causes one-way valve 5 to re-close effectively latching the piston assembly and preventing and further rebound toward its initial or first position. Accumulator 8 is also being recharged while the piston assembly rests in the location of FIG. 4 by way of hydraulic fluid inlet port 6.

Figure 5:
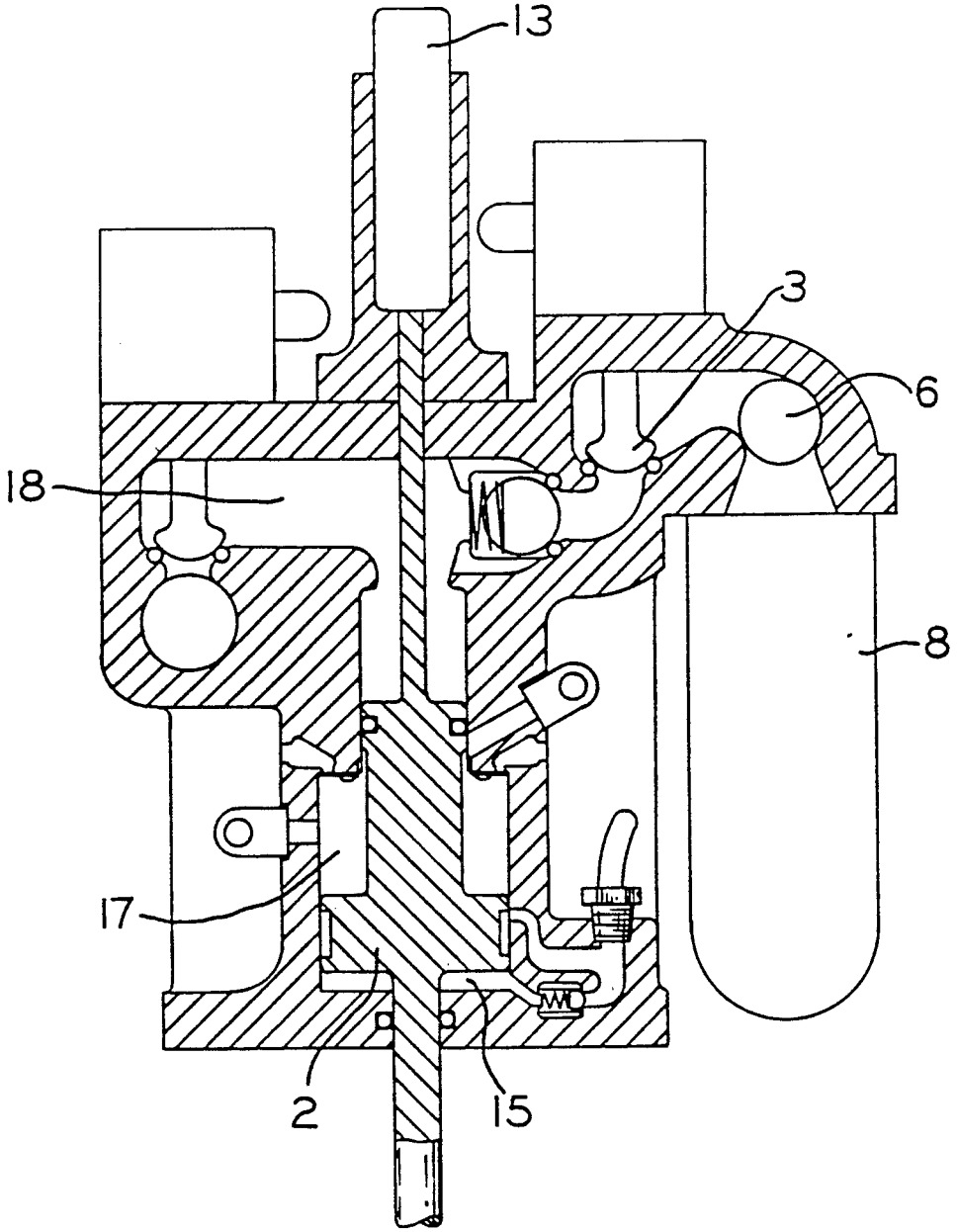
FIG. 5 is a cross-sectional view similar to FIG. 4, but with the first valve closed and the actuator awaiting a command to return to its initial position.

FIG. 5 shows the actuator with the piston assembly in its rightward stable position. The difference between FIGS. 4 and 5 is that all valves are now closed and the fluid in chamber 18 is holding the piston assembly from any motion back toward the left due to the very high pressure urging of the air in chamber 15. Also in FIG. 5, the replenishing of the accumulator 8 fluid supply is nearly completed.

Figure 6:
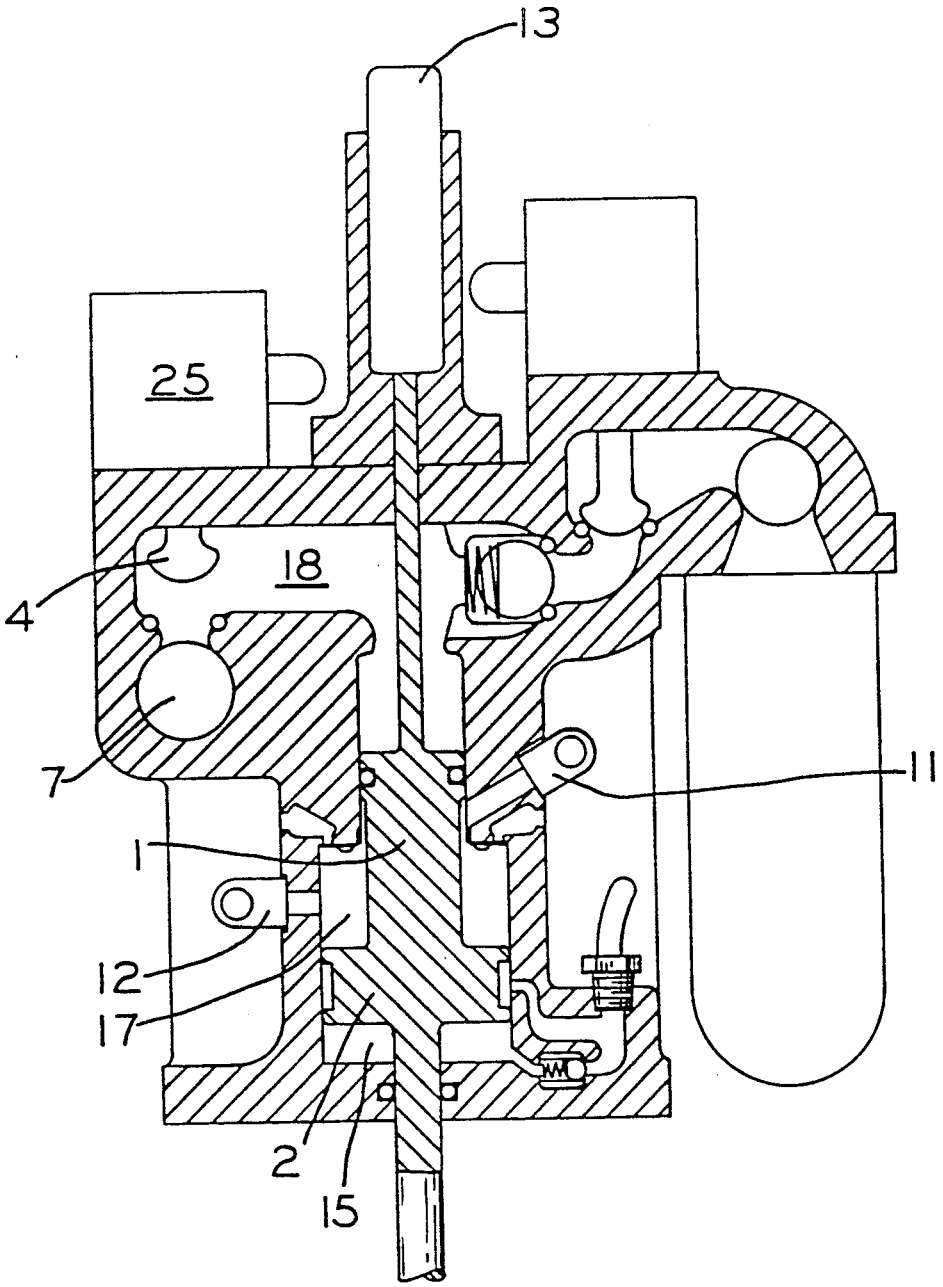
FIG. 6 is a cross-sectional view similar to FIG. 5, but wherein a second valve has opened dumping the latching fluid and allowing the actuator piston to be propelled back to its initial position by the compressed air.

In FIG. 6, a signal to the solenoid 25 has opened ball valve 4 which dumps the hydraulic fluid from chamber 18 into low pressure return port 7. With the high pressure latching pressure removed, the piston assembly is now subjected to a highly unbalanced pressure differential and piston 2 is now free to respond to the high pressure air in chamber 15 which rapidly accelerates the piston assembly back toward its initial left hand position. As the piston assembly moves toward the left, it continues to pump hydraulic fluid from the chamber 18 past valve 4 and into the low pressure return port 7. Also as the piston is moving back toward the left, the air in chamber 17 is being pumped out through both the initial damping orifice 12 and the final damping orifice 11. Each of these orifices 11 and 12 has an adjustable opening so that the initial and final slowing rates may be precisely and independently set.

Figure 7:
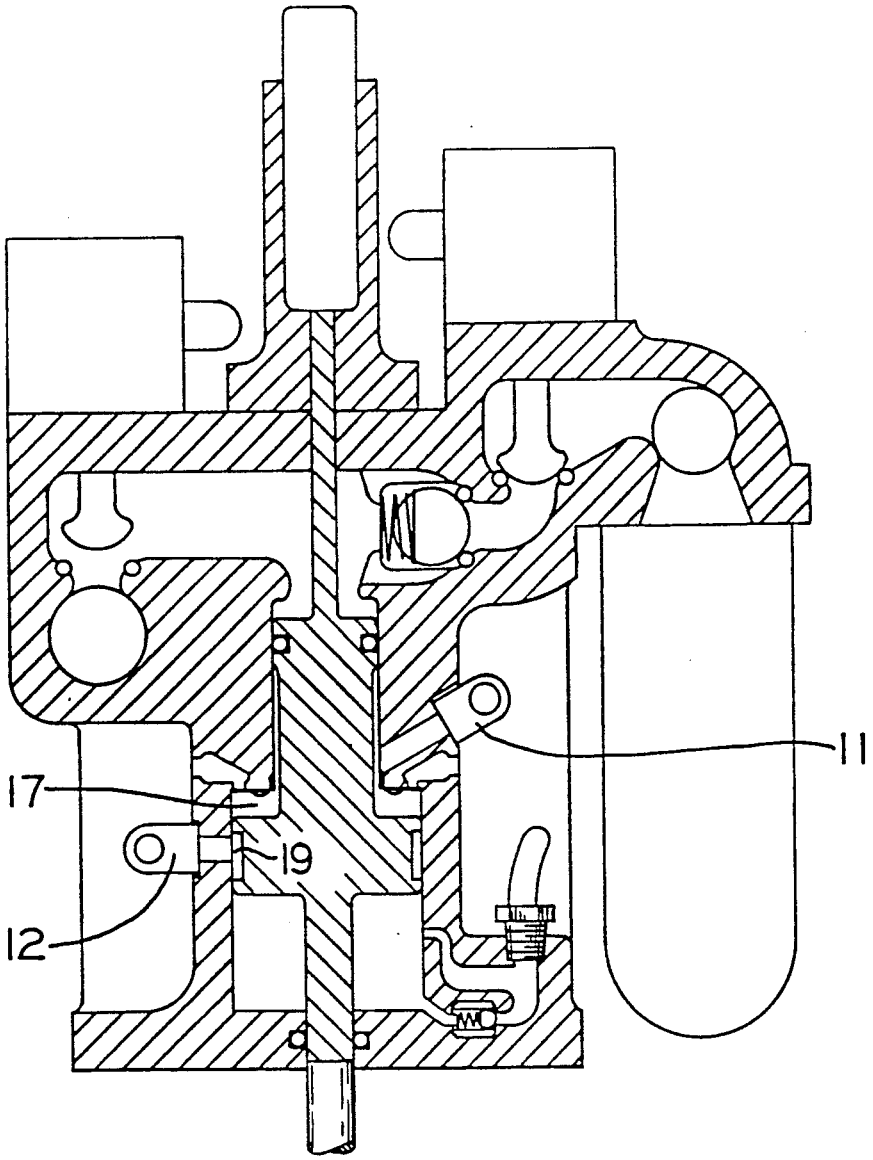
FIG. 7 is a view in cross-section showing the actuator of FIGS. 1–6, returned nearly to the initial position of FIG. 1 and emphasizing the adjustable two stage damping to achieve controlled valve seating.

FIG. 7 illustrates the point in the piston assembly return trip where initial damping has been completed and the piston seal 19 has just closed off the port to orifice 12. Up to this point, damping of leftward motion has been determined by the controlled egress of air from the chamber 17 through both apertures 11 and 12, but, since seal 19 has now covered the opening to aperture 12, the damping is increased and fluid now exits more slowly through aperture 11 only. The size of aperture 11 controls the final damping to assure gentle seating of the poppet valve as the actuator piston assembly reaches its starting or initial position as illustrated in FIG. 1.

Figure 8:
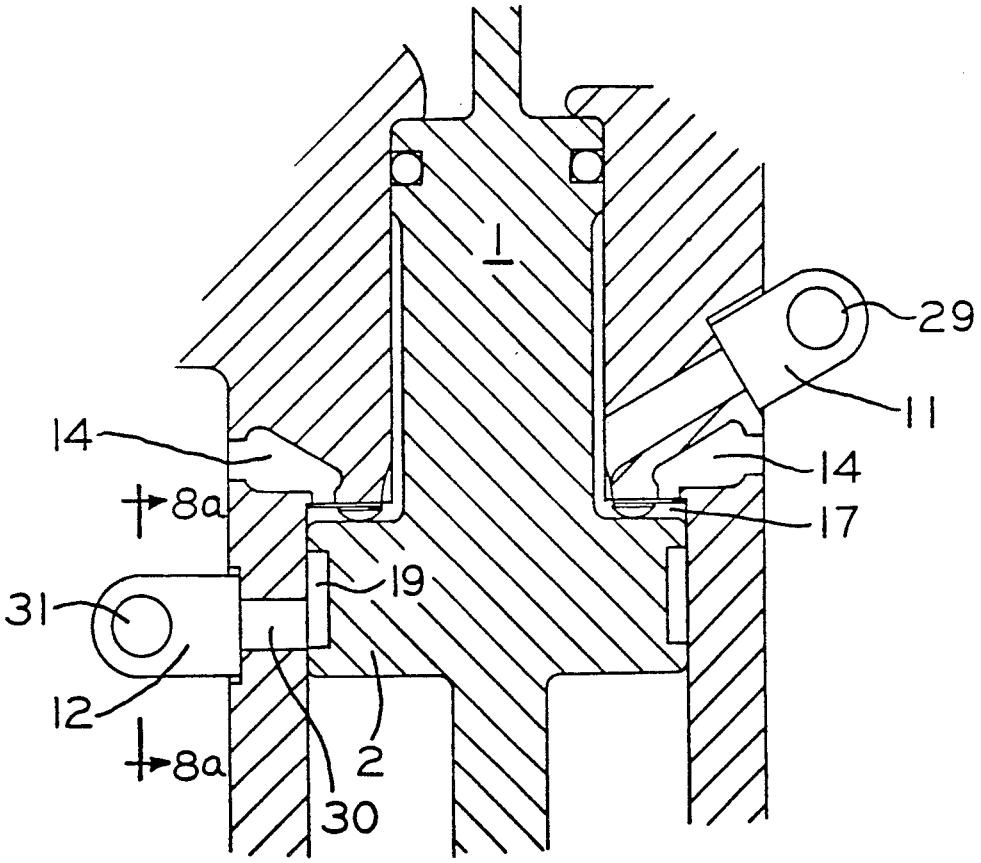
FIG. 8 shows in greater detail the two stage damping arrangement for gentle seating of a poppet valve.
Figure 8A:
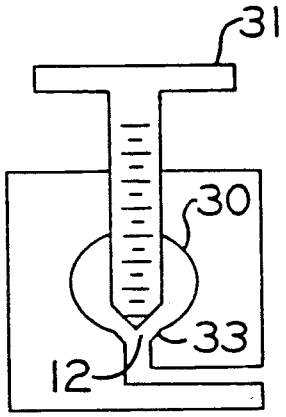
FIG. 8*a* is a view in cross-section of the initial damping aperture along lines 8*a*—8*a* of FIG. 8.

FIG. 8 illustrates in greater detail the dual stage controlled damping used to control the critical seating of the poppet valve. There is an air manifold 14 disposed about at least a substantial portion of the periphery of the cylinder which feeds air through a multi-vane reed valve 27. This allows entry of air into chamber 17 during rightward movement of the piston assembly in a manner virtually free of any throttling retardation or losses. During return motion of the piston assembly toward the left, the reed valve closes and air must escape chamber 17 through the apertures 11 and 12. Adjustable needle valves 29 and 31 are located adjacent and movable into the orifices 11 and 12 for the precise adjustment of the size of these air escapement openings and therefore also of the initial and final damping respectively. The interaction of the adjustable needle valve 31 and the air escape aperture 12 is illustrated in FIG. 8*a* with the needle valve 29 and final damping aperture 11 being structurally similar. Briefly, the aperture 30 extends through the piston wall and communicates with chamber 17 when the piston 2 is in suitable positions such as shown, for example, in FIG. 3. The screw or needle portion of needle valve 31 extends orthogonally to this aperture and seats in a conical seat 33. The separation between the end of the needle and the conical seat defines the size of the aperture and may be varied as the screw is moved in or out. Of course, many other types of adjustable apertures may be employed.

From the foregoing, it is now apparent that a novel arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An asymmetrical bistable hydraulically powered actuator mechanism comprising:

a replenishable source of high pressure hydraulic fluid for causing translation of a portion of the mechanism in one direction;

an opening damping chamber in which air is compressed during translation of the mechanism portion in said one direction, compression of the air slowing the mechanism portion translation in said one direction;

means for temporarily preventing reversal of the direction of translation of the mechanism portion when the motion of that portion slows to a stop; and means operable on command to disable the temporarily preventing means freeing the portion of the mechanism to move under the urging of the air compressed in the opening damping chamber in a direction opposite said one direction.

2. The asymmetrical bistable hydraulically powered actuator mechanism of claim 1 further comprising a closing damping chamber in which air is compressed during translation of the mechanism portion in a direction opposite said one direction for damping translation of the mechanism portion and gracefully slowing the mechanism portion as it returns to the initial position.

3. The asymmetrical bistable hydraulically powered actuator mechanism of claim 2 further comprising a first adjustable aperture allowing air to escape from the closing damping chamber during less than the entire travel of the mechanism portion back to the initial position and a second adjustable aperture for allowing air to escape from the closing damping chamber the entire time the mechanism portion is travelling back to the initial position, coaction of the first and second apertures providing a preliminary mild damping of the motion of the mechanism portion and subsequent action of the second aperture only providing a more severe final damping of the mechanism portion motion.

4. The asymmetrical bistable hydraulically powered actuator mechanism of claim 3 wherein said mechanism portion includes a reciprocable piston having first, second and third working faces each defining a portion of corresponding first, second and third variable volume chambers the volumes of which vary linearly with piston position, said opening damping chamber being the first chamber, the closing damping chamber being the second chamber, and the third chamber comprising a portion of the means for temporarily preventing reversal as well as cooperating with the replenishable source of high pressure hydraulic fluid for causing translation of a portion of the mechanism.

5. The asymmetrical bistable hydraulically powered actuator mechanism of claim 4 further including a first selectively actuable high pressure hydraulic fluid inlet valve connecting the third chamber with the source of high pressure hydraulic fluid and a second selectively actuable high pressure hydraulic fluid drain valve connecting the third chamber with a low pressure hydraulic fluid return.

6. The asymmetrical bistable hydraulically powered actuator mechanism of claim 5 wherein actuation of the first inlet valve initiates translation of the piston in said one direction while actuation of the second outlet valve disables the temporarily preventing means and initiates return of the piston to its initial position, the mechanism further including a second inlet valve for supplying a latching air pressure to the first chamber at least when the piston is in the initial position to latch the piston in the initial position until piston translation is initiated by the first inlet valve.

7. An electronically controllable hydraulically powered valve actuating mechanism for use in an internal combustion engine of the type having engine intake and exhaust valves with elongated valve stems, the actuator comprising;

a power piston reciprocable along an axis and adapted to be coupled to an engine valve;

hydraulic motive means for unilaterally moving the piston, thereby causing the engine valve to move in the direction of stem elongation from a valve-closed to a valve-open position; and pneumatic damping means for compressing a volume of air and imparting a continuously increasing decelerating force as the engine valve approaches the valve-open position; and means operable on command for utilizing the compressed volume of air to power the piston back to the valve-closed position.

8. The electronically controllable hydraulically powered valve actuating mechanism of claim 7 wherein the hydraulic motive means includes a hydraulic fluid accumulator in close proximity to the area of the piston for continuously receiving high pressure fluid and intermittently supplying fluid to power the piston.

9. The electronically controllable hydraulically powered valve actuating mechanism of claim 7 further comprising second pneumatic damping means operable to gracefully slow the piston as it returns to the valve-closed position.

10. The electronically controllable hydraulically powered valve actuating mechanism of claim 9 wherein the second pneumatic damping means comprises a chamber of air compressed by the piston as it returns to the valve-closed position, a first adjustable aperture allowing air to escape from the chamber during less than the entire travel of the piston back to the valve-closed position and a second adjustable aperture for allowing air to escape from the chamber the entire time the piston is travelling back to the valve-closed position, coaction of the first and second apertures providing a preliminary mild damping of piston motion and subsequent action of the second aperture only providing a more severe final damping of the piston motion.

11. A bistable electronically controlled hydraulically powered transducer having an armature reciprocable between first and second positions, hydraulic means for powering the armature from the first position to the second position, a chamber in which air is compressed during motion of the armature from the first position to the second position, compression of the air slowing armature motion as it nears the second position, means for temporarily preventing reversal of armature motion when the motion of the armature has slowed to a stop, the temporarily preventing means being disableable on command to allow the air compressed in the chamber to return the armature to the first position, a second chamber in which air is compressed during motion of the armature from the second position back to the first position, and means for providing a controlled venting of the air from the second chamber and therefore also a controlled damping of the armature motion as that armature moves from the second position back to the first position.

12. The bistable electronically controlled hydraulically powered transducer of claim 11 wherein the hydraulic means for powering includes a hydraulic fluid accumulator in close proximity to the area of the armature for continuously receiving high pressure fluid and intermittently supplying fluid to power the armature.

13. The bistable electronically controlled hydraulically powered transducer of claim 12 wherein the means for providing a controlled venting of air from the second chamber includes a first adjustable aperture allowing air to escape from the chamber during less than the entire travel of the armature back from the second position to the first position, and a second adjustable aperture for allowing air to escape from the chamber the entire time the armature is travelling back to the first position, coaction of the first and second apertures providing a preliminary mild damping of armature motion and subsequent action of the second aperture only providing a more severe final damping of the armature motion.

* * * * *